United States Patent [19]

Austin et al.

[11] 4,315,347

[45] Feb. 16, 1982

[54] FIBERIZATION OF COMPRESSED FIBROUS SHEETS VIA RANDO-WEBBER

[75] Inventors: Jared A. Austin, Appleton; Thomas P. Van Iten, Menasha, both of Wis.

[73] Assignee: Kimberly-Clark Corporation, Neenah, Wis.

[21] Appl. No.: 97,242

[22] Filed: Nov. 26, 1979

[51] Int. Cl.[3] ..... D01G 25/00

[52] U.S. Cl. ..... 19/145.7; 19/105; 19/306

[58] Field of Search ..... 19/145, 145.5, 145.7, 19/148, 296, 306, 105

[56] References Cited

U.S. PATENT DOCUMENTS

| | | | |
|---|---|---|---|
| 1,395,877 | 11/1921 | Tillotson | 19/145.7 X |
| 1,758,428 | 5/1930 | Campbell | 19/105 |
| 1,759,260 | 5/1930 | Hoffmann | 19/145.7 |
| 2,810,163 | 10/1957 | Kyame et al. | 19/96 |
| 3,010,161 | 11/1961 | Duvall | 19/145.5 X |
| 3,862,472 | 1/1975 | Norton et al. | 19/145.5 |
| 3,918,126 | 11/1975 | Wood | 19/306 X |
| 3,961,397 | 6/1976 | Neuenschwander | 19/65 R |
| 4,135,275 | 1/1979 | Gunter | 19/107 |

*Primary Examiner*—Louis Rimrodt

*Attorney, Agent, or Firm*—Stephen R. May; William D. Herrick

[57] ABSTRACT

A method and apparatus for forming non-woven webs by separating fibers from a compacted sheet or sheets of the fibers utilizing a lickerin. The method and apparatus include provision for attaining substantially individual fibers from a compressed sheet of short papermaking fibers such as wood pulp or cotton linters, and also fibers from a compacted sheet of longer fibers such as rayon, and blending the long and short fibers together into a non-woven web in the continuous operation of the lickerin and associated equipment. For the purpose of obtaining the short ($\frac{1}{4}$ inch and less) papermaking cellulosic fibers of wood pulp or the like the nose of the feed bar for the compacted short fibers is spaced a considerable distance from the working circumference of the lickerin such that the compacted sheet tip vibrates and the feed of the sheet of short fibers is substantially radially of the lickerin. Additionally, when forming a composite of long and short fibers the short fibers are freed by the lickerin in the course of lickerin rotation in advance of the freeing of the longer fibers.

5 Claims, 2 Drawing Figures

FIBERIZATION OF COMPRESSED FIBROUS SHEETS VIA RANDO-WEBBER

BACKGROUND OF THE INVENTION

This invention relates to a method and an apparatus for forming non-woven fibrous webs which include as a component a quantity of short cellulosic papermaking fibers of about ¼ inch or less in length.

It is known to employ lickerins for separating fibers from compacted sheets of fibers. One commercial type equipment suitable generally for separating fibers from compacted sheets and blending fibers of several types together into a non-woven web is the Rando-Webber, a unit manufactured by Rando-Machine Corporation, Macedon, N.Y., formerly C. C. of Rochester and employing a lickerin device.

Long fibers of ½ inch and above, used as reinforcing fibers, we have found may be readily separated from compacted sheets of the fibers in normal lickerin operation.

Various expedients have been employed in an attempt to adequately employ such equipment in attaining short fibers of papermaking length in a substantially individualized state, and then blending the short fibers with others in the course of lickerin rotation. We have found that in the usual lickerin arrangement compacted sheets of short cellulosic papermaking fibers (¼ inch in length and less) resist fiberizing and tend to result in fiber clumps and clogging of the teeth of the lickerin. This requires frequent equipment cleaning and in some cases additional equipment directed to fiber clump removal.

The present invention is directed to modifying conventional lickerin practice to materially improve equipment operation and the fiberizing of sheets of short cellulosic fibers which may be blended in the equipment operation with longer reinforcing fibers or the like.

SUMMARY OF THE INVENTION

In accordance with the present invention the lickerin equipment is modified for the feeding of compacted sheets of short cellulosic fibers. We have found that in contrast to the feed of the compacted sheets in a direction tangential to the lickerin in its rotation that for sheets of short fibers the feed should be radial or substantially so for best results. Additionally, the spacing between the nose of the feed bar and the teeth should be such that the compacted fiber sheet projecting from the feed bar to the teeth is vibrated by tooth contact; such materially aids the fiberizing of the sheets to produce substantially individual fibers of papermaking length (¼ inch or less). A spacing of about 0.050 inch usually serves the purpose well.

To improve blending of long and short fibers in the operation of the equipment the feed of the compressed sheets of longer fibers should follow, in the rotation of the lickerin, the feed of the compacted fibrous sheets of short fibers. The nose to tooth spacing for the longer fibers may be conventional, that is about 0.005 inches to 0.007 inches so that the long fibers are tightly nipped when they interact with the lickerin. Under these circumstances it appears that the short length fibers are carried in the usual air stream of the lickerin; the longer fibers tend to lie across the closely spaced lickerin teeth and the short fibers in the air stream blend intimately with the long fibers and do not clog the lickerin because of their position on the long fibers.

The operating arrangement is described in further detail in connection with the accompanying drawings corresponding to the following description.

DETAILED DESCRIPTION OF THE DRAWINGS

Figure 1:
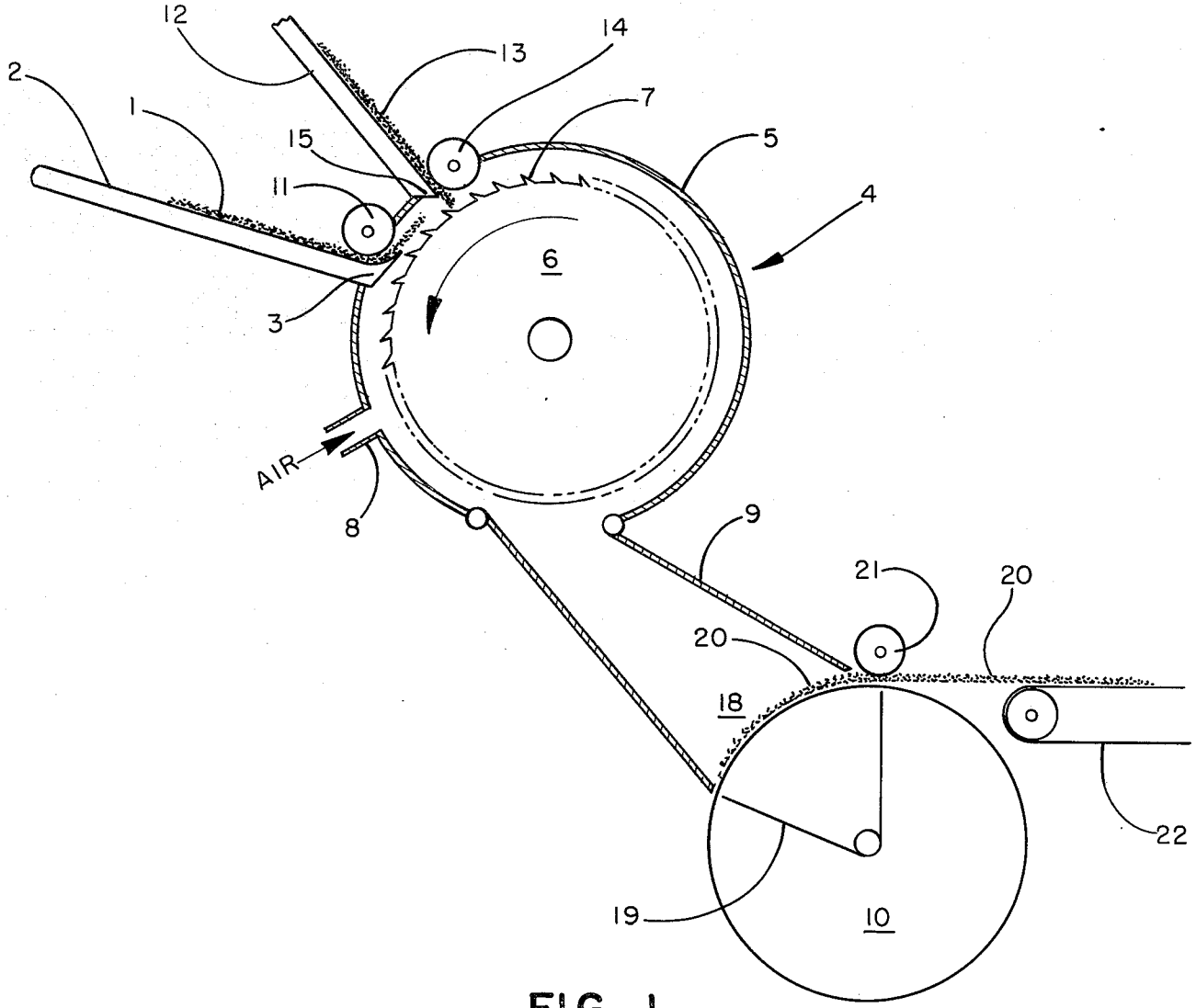
FIG. 1 is a diagrammatic side elevational view in accordance with the invention showing a lickerin and cylinder arrangement adapted for the formation of non-woven webs.

Referring to FIG. 1 an equipment arrangement for the fiberizing of sheets of compacted fibers and the collection of the individualized fibers as a non-woven web is illustrated. The numeral 1 designates a dense or compacted fibrous sheet of long fibers, such as rayon which is directed over a feed bar 2 toward the nose 3 of the bar and to a fiberizer generally indicated at 4. The fiberizer includes a housing 5 in which a lickerin roll or toothed roll 6 is rotated by means not shown. The lickerin teeth are indicated by numeral 7 and in usual practice are understood to leave a clearance with nose bar 3 of about 0.005 inch to 0.007 inch. Air is directed into the housing 5 at 8 to form an air stream to carry separated fibers through conduit 9 to a condensing screen 10. As shown in FIG. 1 the nose 3 of the bar 2 is provided with a feed roll 11 which presses on sheet 1 and the feeding sheet 1 is urged by the roll 11 to nose 3. The compressed sheet due to the contour of nose 3 is presented essentially tangentially to the teeth of the lickerin which rotates counter clockwise as shown by the arrow. The arrangement of feed bar 2 and nose 3 FIG. 1 is generally suitable for separating fibers from compacted sheets of long fibers, that is, ½ inch or more. We have found it to be inadequate however to effect fiberizing of compacted sheets of fibers of papermaking length, that is about ¼ inch and less.

Figure 2:
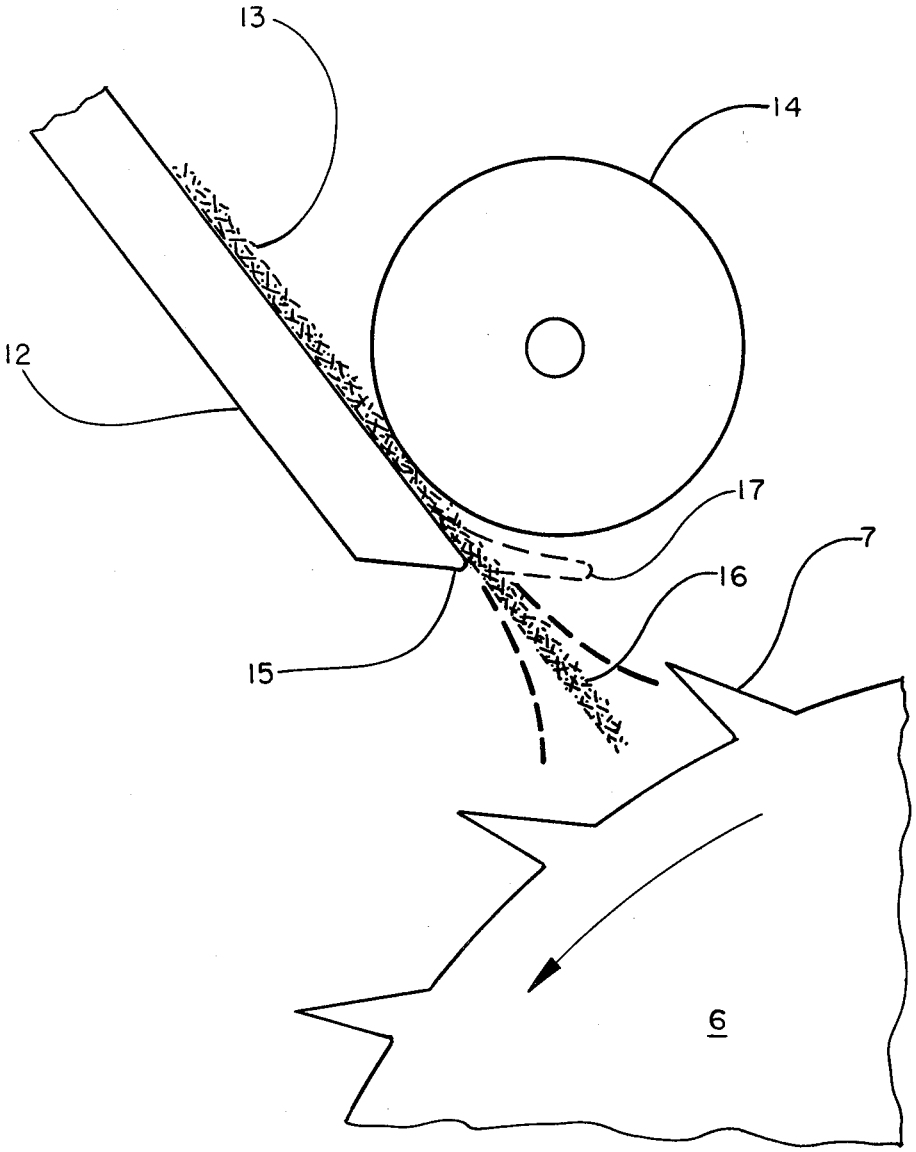
FIG. 2 is an enlarged view of the fiber feed bar arrangement of FIG. 1 illustrating the feeding of a compacted sheet of short fibers.

To effect the fiberizing of compacted sheets of short fibers we have found that certain modifications, particularly to the feed bar, and its relation to the lickerin teeth is desired. Referring to FIGS. 1 and 2, the numeral 12 designates a feed bar for compacted sheets of short fibers. One such sheet is indicated by the numeral 13. The feed roll 14 directs the sheet 13 over a relatively blunt nose 15 to the lickerin teeth. The nose 15 is well spaced from the teeth, about 0.050 inch, so that the end 16 of the compacted fiber sheet 13 projects toward the teeth for impact by them. Such impact it is understood causes the end 16 to vibrate as indicated by the dash lines in FIG. 2. Such vibration of a sheet to be fiberized is believed contrary to the practice employed in lickerin operation though known in other types of fiberizing equipment; in any event we have found that the combination of a spacing such that the sheet vibrates with a feed which is radial rather than tangential leads to very adequate fiberizing of sheets of short fibers. As shown in FIG. 2 by the dashed lines (at the blunt nose 15) the mechanical modification of the feed bar is accomplished by simply removing the usual curvilinear nose end represented in dash-dot lines at 17.

The nose 15 is suitably rounded at its extremity to provide for smooth movement of the compacted sheet to the teeth 7 and flexing of the sheet under the impact of the teeth. The spacing between the nose and the teeth is selected to be such that the sheet may vibrate readily, the spacing increasing with sheet thickness. A sheet thickness of between about 0.040 inch and 0.200 inch with a spacing of about 0.050 inch is suitable for the purpose. It is considered that a spacing range of 0.040 inch to 0.060 inch approximately may be employed.

The teeth 7 for our purpose may have a zero rake angle or a slight positive rake angle as shown in FIG. 2. The angle of rake does not appear to be a critical factor in the attainment of suitable fiberization.

In the practice of the invention the air stream developed within the housing 5 and moving with the lickerin 6 in its rotation tends to carry the short fibers of wood pulp, cotton linters, or the like along to the zone of fiberization of the longer fibers. There appears to be little tendency for the fibers freed at the extremity 16 to become retained by the teeth or to clog the teeth. The longer fibers when drawn by the teeth tend to lie across successive oncoming teeth and to be readily removable from the lickerin. In the practice of this invention the shorter papermaking fibers are apparently deposited from the air stream on the longer fibers intimately intermingling with them and being carried with them through the duct 9 (FIG. 1) to the condenser or collector screen 10.

In specific application a compacted sheet of wood pulp fiber 13 (FIG. 1) having a weight per square yard of about 18 oz. is fed at about 6 feet/minute to the lickerin 6. The thickness of the compacted sheet is about 0.100 inch and the width 39 inches. A similar sheet 1 of compacted rayon fibers is fed at about 5 feet/minute over the nose 3 of feed bar 2 to lickerin 6. Lickerin 6 may have a diameter of 9 inches to 24 inches and rotates at a speed of about 6,000 feet per minute in the direction indicated by the arrow. At a diameter of 24 inches the RPM employed is somewhat less so that the surface speed is about 8,000 feet per minute. The fibers drawn from the compacted sheets by the lickerin teeth become intimately mixed within the housing 5 and are conducted while intimately mixed to the conduit 9 and collector 10.

Collector 10 is a rotating screen which is subjected at the collecting zone 18 fronting on conduit 9 to vacuum pressure; the vacuum is applied through housing 19 by means well known in the art and not shown.

In the specific example under consideration the collector moves at about 20 feet per minute and a web 20 of about 39 inches width is collected at the collecting zone 18. Such web has a weight of about 5 oz. per square yard. The speed of the collector may be increased to decrease the square yard weight or decreased to attain a web of higher weight. The composite in the present instance has a short fiber content of about 60%, the longer fibers serving to reinforce the short fibers which in the substantially uncompressed state of the web afford little strength to the composite. The composite or web of blended fibers is withdrawn from collector 20 under press roll 21 and leaves the equipment on conveyor belt 22.

The weight of the web 20 may be increased by increasing the speed of feed of either of the compacted sheets 1 and 13 as will be understood. However slower feeds tend to contribute to improved fiberizing, that is, the attainment of individual fibers.

The operation of the equipment has been specifically set out in connection with providing a web product which is a blend of long and short fibers. This latter is a primary purpose of the invention but webs of only long or of short fibers may be attained if desired. Generally wood pulp or cotton linters are a component of the feed of the equipment as the latter lends itself well to the production of blends of fibers. The long fibers may be of rayon, nylon and the like, that is fibers usually having a length greatly exceeding ½ inch and up to 2 to 2½ inches or more. The short fibers of a blend may constitute 20–80% by weight of the blend depending upon the purpose for which the web product is intended.

As many apparently widely different embodiments of this invention may be made without departing from the spirit and scope thereof, it is to be understood that we do not limit ourselves to the specific embodiments thereof except as defined in the appended claims.

We claim:

1. A method for producing a non-woven fibrous web comprising a blend of short cellulosic fibers of papermaking length and longer reinforcing fibers, comprising the steps of:

(a) feeding a compacted batt of short cellulosic fibers of papermaking length substantially radially to a rotating lickerin over a first nose bar such that said fibers are removed from said batt;

(b) feeding a second compacted batt of longer reinforcing fibers over a second nose bar to the lickerin following the first nose bar in the course of lickerin rotation such that said fibers are removed from said batt so as to intimately blend the long and short fibers;

(c) doffing the blend of short cellulosic fibers and the longer reinforcing fibers from the lickerin and directing the blend to a condensing screen to form a web, the improvement comprising:

positioning said first nose bar such that it is separated from said lickerin by at least 0.040 inches, such that said short cellulosic fibers are removed from said compacted batt by vibratory forces generated by said lickerin impacting said compacted batt.

2. The process as recited in claim 1 wherein the spacing between the first nose bar and lickerin is between about 0.040 inch to about 0.060 inch.

3. The process as recited in claim 1 wherein the short cellulosic fibers of papermaking length doffed from the lickerin are a major proportion by weight relative to the longer reinforcing fibers.

4. The process as recited in claim 1 wherein the speed of the lickerin is between about 6,000 and 8,000 feet per minute.

5. The process as recited in claim 1 wherein the spacing between the first nose bar and lickerin is about 0.050 inch and the short cellulosic fibers of papermaking length are a major proportion by weight relative to the longer reinforcing fibers.

* * * * *